US005280658A

United States Patent [19]

Sigl

[11] Patent Number: 5,280,658

[45] Date of Patent: Jan. 25, 1994

[54] SLAT GRATING INSERT FOR A BED

[76] Inventor: Herbert Sigl, Thurerweg 3, 5162 Obertrum am See, Austria

[21] Appl. No.: 806,043

[22] Filed: Dec. 12, 1991

Related U.S. Application Data

[63] Continuation of PCT/AT91/00028, filed on Feb. 19, 1991.

[30] Foreign Application Priority Data

Apr. 12, 1990 [AT] Austria ..... 876/90

[51] Int. Cl.[5] ..... A47C 23/06

[52] U.S. Cl. ..... 5/236.1; 5/191

[58] Field of Search ..... 5/236.1, 237, 238, 239, 5/241, 244, 191

[56] References Cited

U.S. PATENT DOCUMENTS 4,222,134 9/1980 Degen ..... 5/238

4,567,615 2/1986 Fanti ..... 5/191

FOREIGN PATENT DOCUMENTS 0274371 7/1988 European Pat. Off. .

3905879 8/1990 Fed. Rep. of Germany ..... 5/236.1

4354440 5/1948 Italy ..... 5/236.1

663528 12/1987 Switzerland .

*Primary Examiner*—Alexander Grosz

[57] ABSTRACT

An insert for a bed with a rigid support frame comprises a slat grating formed of spring slats extending transversely to the longitudinal axis of the bed. Each of the slats includes an upper and a lower strip of substantially equal length disposed on top of one another. The strips are spaced apart by elastic form bodies. Elastic support bodies are disposed below said lower strips for supporting the insert on the rigid frame. The support bodies are disposed below the ends of the lower strips and below the center of the for supporting the slats. Advantageously, the form bodies and support bodies at the ends of the slats are formed integrally as one piece.

11 Claims, 4 Drawing Sheets

Fig.7
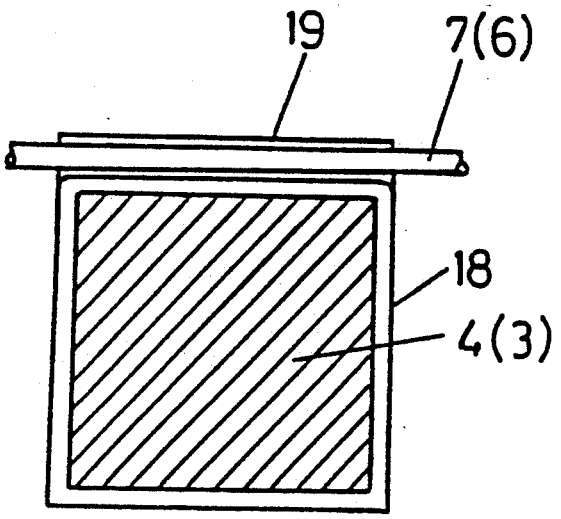
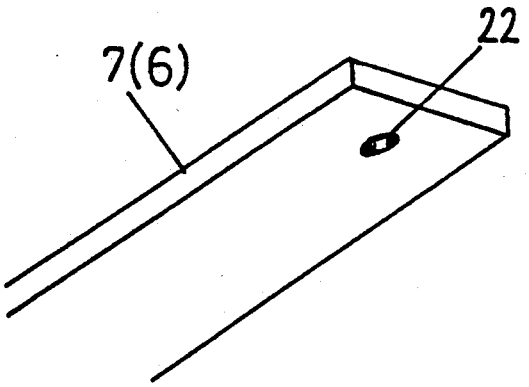
Fig. 8

SLAT GRATING INSERT FOR A BED

CROSS-REFERENCE TO RELATED APPLICATIONS

This application is a continuation of International application PCT/AT91/00028, filed on Feb. 19, 1991 and designating the United States of America.

BACKGROUND OF THE INVENTION

1. Field of the Invention:

The invention relates to an insert for a bed in the form of a grating having spring slats extending transversely to the longitudinal axis of the bed, each of the slats comprising two strips of equal length spaced apart from each other by elastic form bodies, whereby elastic support bodies are provided on the bottom of the lower strips for supporting the insert on a rigid support frame.

A device of this general kind is known from European Patent EP-B1 151 218. The support according to that publication, however, lacks any suggestion towards elastic support bodies between the lower strips and the rigid support frame. In the known device the rigid support consists of two longitudinal carriers which extend at a lateral distance from the ends of the spring slats. With such a configuration it is rather difficult to attain a satisfactory elasticity distribution transversely to the longitudinal axis of the bed, i.e. it can hardly be avoided that areas of substantially decreased flexibility result along the supporting longitudinal carriers as well as along the longitudinal axis of symmetry and, furthermore, the marginal regions show a rather unaesthetic tendency to bend upwardly.

It is useful, as it is known from European published patent application EP-A1 385 121, to interconnect the support and/or form bodies of adjacent spring slats or to produce them from a uniform elastic body, in particular from Latex. The connection between the support and form bodies on the one hand and the strips on the other hand can thereby be effected, as also shown in EP-A1 385 121, by wrapping the elastic bodies with a fabric and by extending the strips through splice straps or tongues of the wrapping. Connecting the support or form bodies in the longitudinal direction has the advantage that the spring slats are interconnected to form a uniform grating which can be easily handled and, for example, be rolled up.

A structurally simple solution for the lateral support bodies is characterized in that the lateral support bodies disposed at the ends of the lower strips are formed of a single piece with the form bodies spacing the upper from the lower strips. Elastic support bodies which support spring slats on a rigid insert are also known from European patent application EP-A-0 274 371. They can only serve, however, to either receive two strips or to support on one support. Sufficient elasticity of the form body is only given when one of its two openings remains free. At the location where the spring slat is supported, it must always be formed of a single part. On the other hand, a second strip protruding through the second bore for stiffening the carrying strip can only be provided in the unsupported region.

It is accordingly an object of the invention to provide a slat grating insert for a bed, which overcomes the hereinafore-mentioned disadvantages of the heretofore-known devices of this general type and which provides uniform and adjustable flexibility in all areas of the bed.

With the foregoing and other objects in view there is provided, in accordance with the invention, an insert for a bed having a rigid frame and a longitudinal axis, comprising a slat grating formed of spring slats extending transversely to the longitudinal axis of the bed, each of the slats including an upper and a lower strip of substantially equal length spaced one above the other, the strips having ends and a central region, elastic form bodies spacing the upper and lower strips apart from one another, elastic support bodies disposed below the lower strips for supporting the insert on the rigid frame, the elastic support bodies being disposed below the ends and the center of the lower strips for supporting the lower strips.

In accordance with an added feature of the invention, the elastic support bodies are provided at all of the ends of the lower strips.

In accordance with an additional feature of the invention, the insert includes means for connecting adjacent elastic support bodies to one another.

In accordance with another feature of the invention, the elastic support bodies disposed at the ends of the lower springs are formed in one piece with the form bodies for spacing the upper and lower strips from one another.

In accordance with a further feature of the invention, the form bodies and the support bodies have protrusions formed thereon and the upper and lower strips have openings formed therein for receiving the protrusions. This assures that the support bodies remain locked in their respective locations.

In accordance with again another feature of the invention, the support bodies which are disposed at the ends of the strips are less elastic than the support bodies disposed in the center of the strips.

In accordance with again an added feature of the invention, the support bodies disposed at the ends of the strips are formed of solid rubber and the support bodies disposed at the centers are formed of foamed rubber.

In accordance with again a further feature of the invention, the form bodies for spacing the strips apart are disposed only at the ends of the strips.

In accordance with yet an additional a feature of the invention, the form bodies for spacing the strips apart are disposed only between the support bodies.

In accordance with a further feature of the invention, the form bodies disposed between the support bodies are displaceable along the strips.

In accordance with a concomitant feature of the invention, the form bodies are formed of foamed rubber.

It is an essential advantage of the central disposition of the elastic support bodies for the lower strips according to the invention that in this way the flexibility of the individual spring slats along the longitudinal direction of the bed may be varied. When the distancing form bodies, which are disposed between the ends and the centers of the strips, are pushed towards the ends, then the upper strip is bent fully and it is held together with the lower strip essentially by the centrally disposed support body. When the spacer form bodies are pushed toward the center, however, a substantial stiffening of the spring slats is attained since sagging is no longer possible when the spacer form body and the centrally disposed support body are compressed. This interaction of the strips and the form and support bodies works best when the strips are no thicker than approximately 5–6 mm, and when the form and support bodies are made of a foam material, in particular a foam rubber.

The invention, in contrast to the prior art, attains a harmonic and uniform distribution in the flexibility of the insert while at the same time limiting its sagging, in that elastic support bodies are provided at least in the center of the lower strips which are supported only in the center and at the ends.

Although it is the essential object of the invention to elastically limit the sagging of two-part spring slats, it is useful to also elastically support the ends of the spring slats, in order to make the flexibility of the slat grating transversely to the longitudinal direction of the bed as evenly distributed as possible. It will thus be usual to also provide elastic support bodies at the ends of the lower strips.

Other features which are considered as characteristic for the invention are set forth in the appended claims.

Although the invention is illustrated and described herein as embodied in a slat grating insert for a bed, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 7 is a cross-sectional view of a second embodiment of the laterial support bodies; and FIG. 8 is a partial, perspective view of a spring slat according to the invention.

DETAILED DESCRIPTION OF THE PREFERRED EMBODIMENTS

Figure 1:
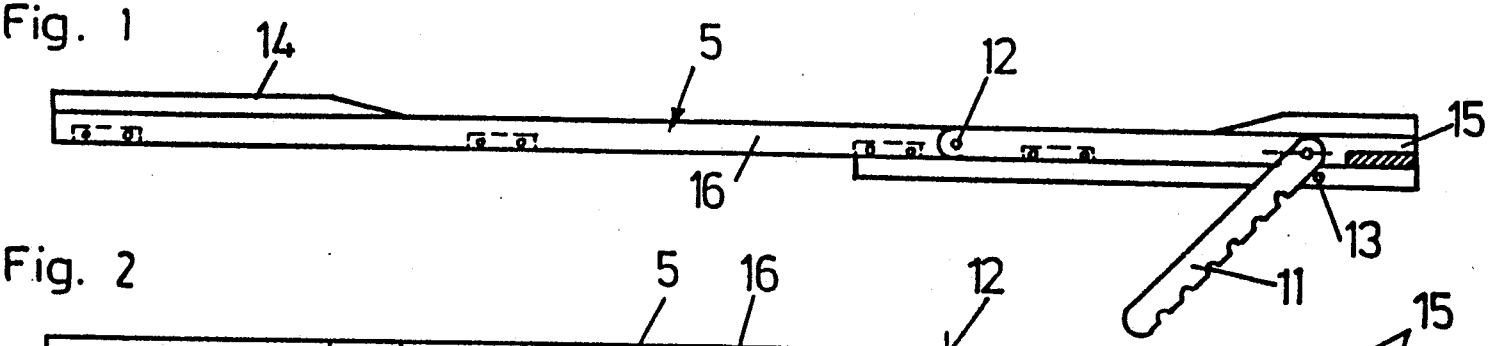
FIG. 1 is a side-elevational view of a rigid support frame.
Figure 2:
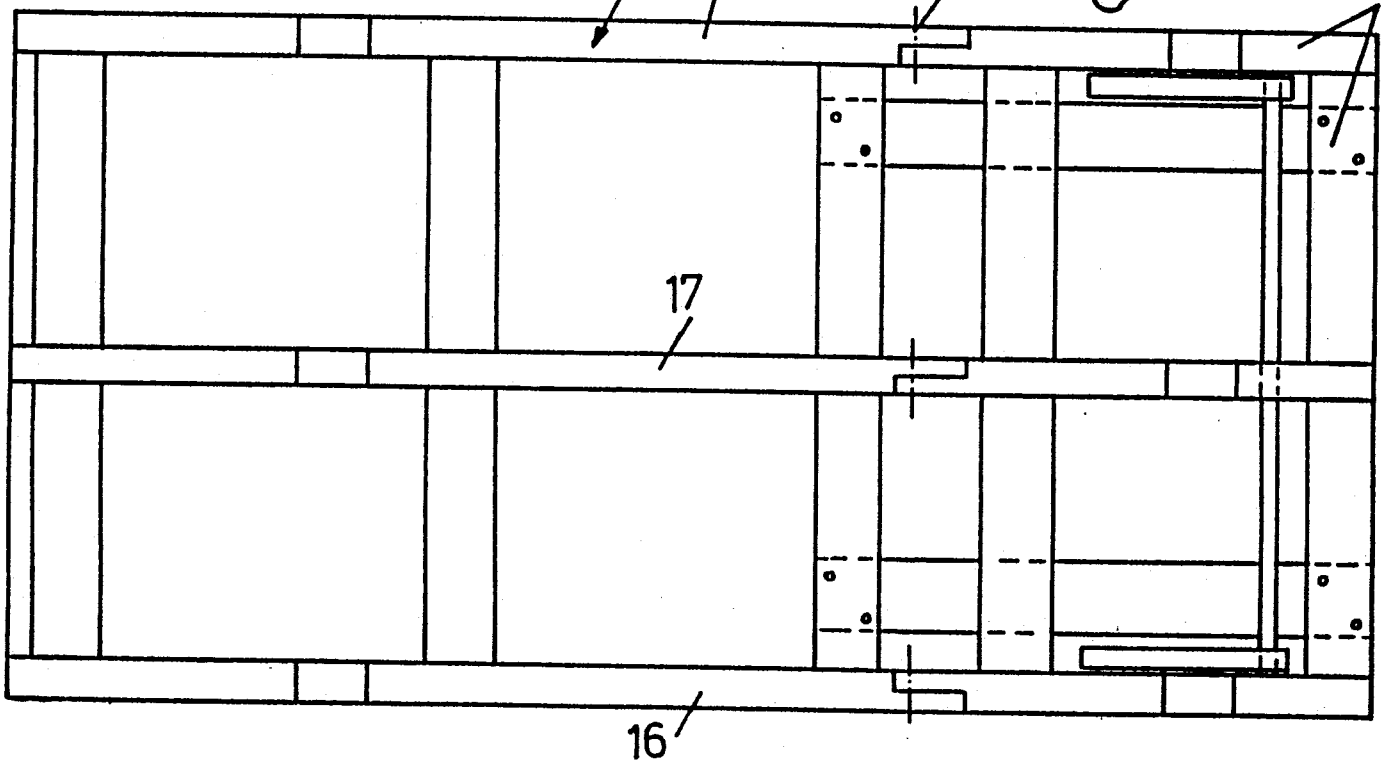
FIG. 2 is a top-plan view of the rigid frame of FIG. 1.

Referring now to the figures of the drawings in detail and first, particularly, to FIGS. 1 and 2 thereof, there is seen a support frame 5 with two lateral longitudinal carriers 16 and a central longitudinal carrier 17 on which the slat grating according to the invention can be supported. It is thereby not necessary for the insert 5 to form a totally horizontal support for the grating. It may even be advantageous to provide a riser 14 for raising the foot region and to make a head region 15 pivotable about an axis 12. It is thus possible to retain this head region in a given adjustable angular position on a holding rod 13 by means of serrated slats 11.

Figure 3:
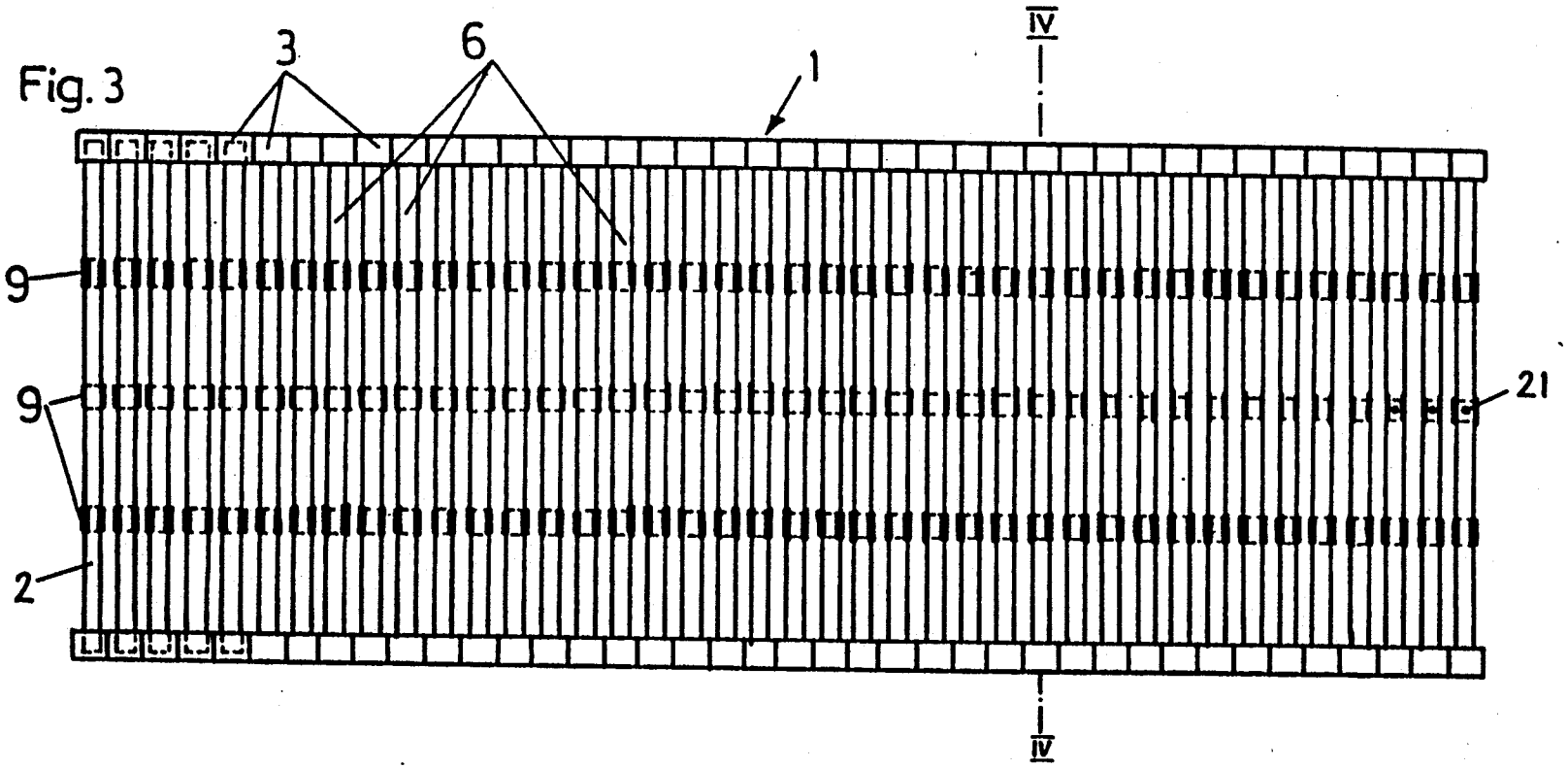
FIG. 3 is a top-plan view of a grating according to the invention.
Figure 5:
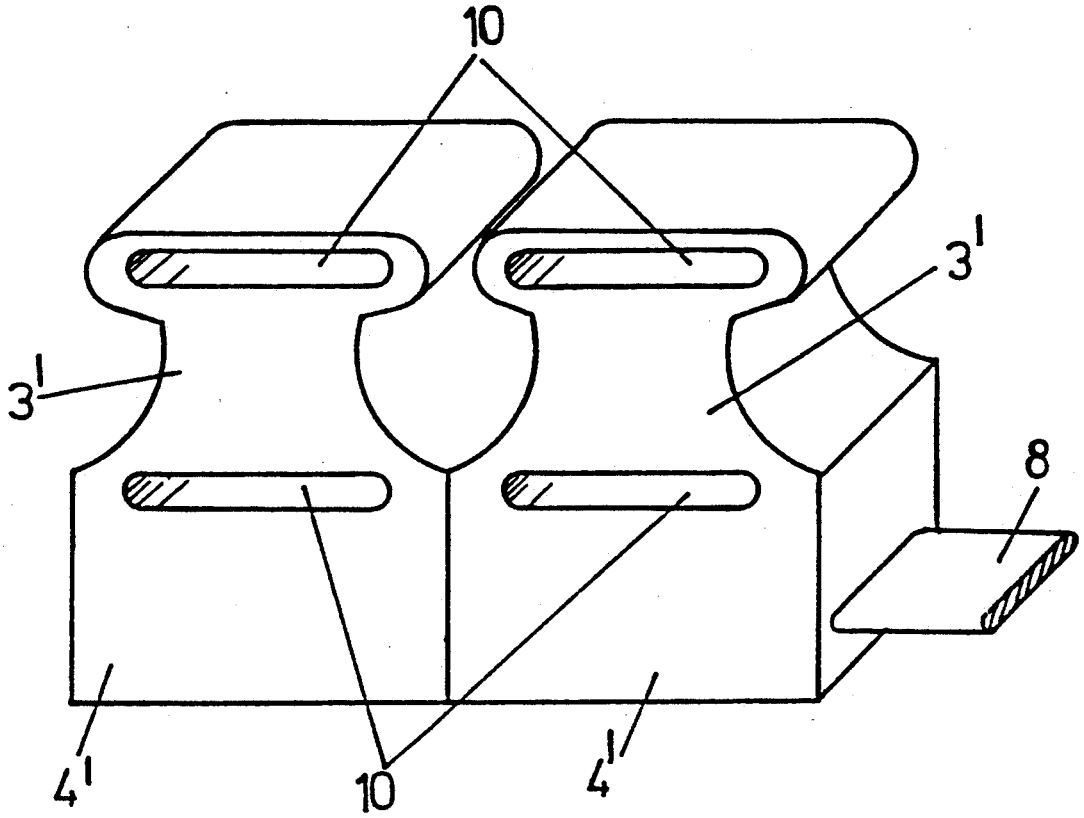
FIG. 5 is a perspective view of a first embodiment of two support bodies to be disposed at the edges of the strips.

The slat grating 1 according to the invention shown in FIG. 3 is placed onto the frame insert 5; the grating 1 comprises a plurality of adjacent spring slats 2 which may be attached to one another by means of straps 8 (cf. FIG. 5).

Figure 4:
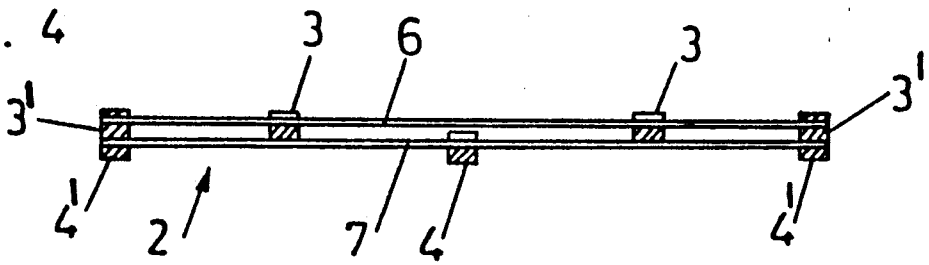
FIG. 4 is a cross-sectional view taken along the line IV-IV in FIG. 3.

As illustrated in FIG. 4, the spring slats 2 are each formed of an upper strip 6 and a lower strip 7 between which there are disposed elastic form bodies 3. The slats are preferably formed of wood, but other materials are equally possible. The support of the lower strips 7 according to the invention is effected through elastic support bodies 4 and 4' at the lateral longitudinal carriers 16 and at the central longitudinal carrier 17 of the rigid frame insert 5.

Figure 6:
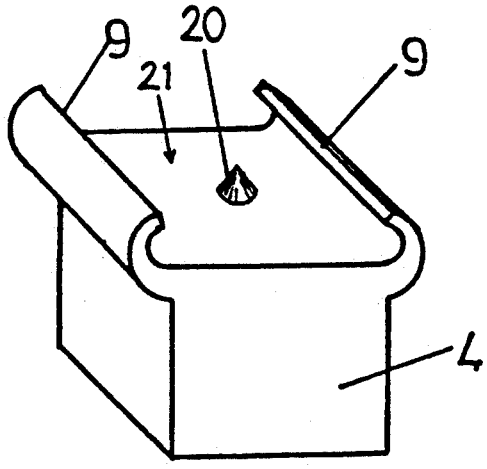
FIG. 6 is a perspective view of a support body to be disposed in the central region of the strips.

The structure of the form bodies 3 and of the support bodies 4 and 4' becomes clear from FIGS. 5-7. The form bodies 3' in the end regions of the spring slats 2 whose clearances 10 receive the upper and lower strips 6 and 7, respectively, are formed in one piece with the support bodies 4 for the lower support. The support bodies 4' of adjacent spring slats 2 are connected by a common strap 8 formed of cotton, for example.

In order to avoid the pulling out of the strips 6 and 7 from the clearances 10, protrusions 20 may be provided on the inside of the clearances 10 which would engage with bores 22 provided at the ends of the strips 6 and 7 (FIG. 8). One such protrusion 20 is illustrated on the support surface of the support body 4 shown in FIG. 6.

In the central section of the spring slats 2 the support bodies 4 are formed in accordance with FIG. 6. Only their upper marginal edges 9 embrace the strips 7 disposed on their support surface 21. Since the protrusions 20 are usually disposed only on the inside of the clearances 10 of the support bodies 4' and the form bodies 3', the support bodies 4 of FIG. 6 are easily slidable along the lower strips 7. The form bodies 3 are also constructed identically with the support body 4 in accordance with FIG. 6, advantageously with a different modulus of elasticity. The ready slidability is desirable especially for the form bodies 3 which are located between the central support bodies 4 and the combined support and form bodies 3', 4' in the end regions (cf. FIG. 4). By means of laterally displacing the form bodies 3, the stiffness of the slat grating 1 may be varied transversely to the longitudinal direction of the bed.

Instead of providing separate form bodies 3 and support bodies 4, a single support body 4—as shown in FIG. 7—may be provided which extends over the entire length of the slat grating 1. In order to attach the individual slats to this support body, the latter may be wrapped with a fabric 18, whereby latches 19 allow attachment of the slats.

I claim:

1. Insert for a bed having a rigid frame and a longitudinal axis, comprising a slat grating formed of spring slats extending transversely to the longitudinal axis of the bed, each of said slats including an upper and a lower strip of substantially equal length spaced one above the other, said strips having ends and a central region, elastic form bodies spacing said upper and lower strips apart from one another, elastic support bodies disposed below said lower strips for supporting the insert on the rigid frame, said elastic support bodies being disposed below said ends and said center of said lower strips for supporting said lower strips.

2. Insert according to claim 1, wherein said elastic support bodies are provided at all of said ends of said lower strips.

3. Insert according to claim 1, including means for connecting adjacent ones of said elastic support bodies to one another.

4. Insert according to claim 1, wherein said elastic support bodies disposed at said ends of said lower springs are formed in one piece with said form bodies for spacing said upper and lower strips from one another.

5. Insert according to claim 4, wherein said form bodies and said support bodies have protrusions formed thereon and said upper and lower strips have openings formed therein for receiving said protrusions.

6. Insert according to claim 1, wherein said support bodies disposed at the ends of said strips are less elastic than said support bodies disposed in said center of said strips.

7. Insert according to claim 6, wherein said support bodies disposed at the ends of the strips are formed of solid rubber and said support bodies disposed at said centers are formed of foamed rubber.

8. Insert according claim 1, wherein said form bodies for spacing said strips apart are disposed only at said ends of said strips.

9. Insert according claim 1, wherein said form bodies for spacing said strips apart are disposed only between said support bodies.

10. Insert according to claim 9, wherein said form bodies disposed between said support bodies are displaceable along said strips.

11. Insert according to claim 10, wherein said form bodies are formed of foamed rubber.

* * * * *